US005757375A

United States Patent [19]

Kawase

[11] Patent Number: 5,757,375

[45] Date of Patent: May 26, 1998

[54] COMPUTER GRAPHICS SYSTEM AND METHOD EMPLOYING FRAME BUFFER HAVING SUBPIXEL FIELD, DISPLAY FIELDS AND A CONTROL FIELD FOR RELATING DISPLAY FIELDS TO THE SUBPIXEL FIELD

[75] Inventor: Kei Kawase, Sagamihara, Japan

[73] Assignee: International Business Machines Corporation, Armonk, N.Y.

[21] Appl. No.: 506,704

[22] Filed: Jul. 25, 1995

[30] Foreign Application Priority Data

Aug. 11, 1994 [JP] Japan ..... 6-189188

[51] Int. Cl.[6] ..... G09G 5/36

[52] U.S. Cl. ..... 345/429; 345/136; 345/189; 345/190

[58] Field of Search ..... 395/119, 122, 395/127, 131, 142–3, 508–516, 520–1; 345/419, 422, 427, 431, 501, 136, 189–90

[56] References Cited

U.S. PATENT DOCUMENTS

| | | | |
|---|---|---|---|
| 5,123,085 | 6/1992 | Wells et al. | 395/121 |
| 5,237,650 | 8/1993 | Priem et al. | 395/143 |
| 5,257,103 | 10/1993 | Vogeley et al. | 358/140 |
| 5,274,760 | 12/1993 | Schneider | 395/162 |
| 5,287,438 | 2/1994 | Kelleher | 395/132 |
| 5,327,159 | 7/1994 | Van Aken et al. | 345/153 |
| 5,343,558 | 8/1994 | Akerley | 395/126 |
| 5,347,618 | 9/1994 | Akerley | 395/121 |
| 5,388,205 | 2/1995 | Cantor et al. | 395/162 |
| 5,416,897 | 5/1995 | Albers et al. | 395/143 |
| 5,420,608 | 5/1995 | Choi et al. | 345/186 |
| 5,473,342 | 12/1995 | Tse et al. | 345/132 |
| 5,519,823 | 5/1996 | Barkans | 395/130 |
| 5,555,359 | 9/1996 | Choi et al. | 395/141 |
| 5,594,854 | 1/1997 | Baldwin et al. | 395/141 |
| 5,613,054 | 3/1997 | Albers et al. | 395/143 |

OTHER PUBLICATIONS

K. Akeley, "Reality Engine Graphics", Computer Graphics Proceedings Annual Conference Series, 1993 pp. 109–116.

*Primary Examiner*—Joseph H. Feild
*Assistant Examiner*—Rudolph Buchl
*Attorney, Agent, or Firm*—Perman & Green, LLP

[57] ABSTRACT

A computer graphics system is disclosed for generating pixel data corresponding to a plurality of pixels to be displayed. The computer graphics system includes a frame buffer having entries associated with each of the pixels. Each of the entries includes a subpixel data field, a plurality of display data fields, and a control field. For each entry the sub-pixel data field stores data corresponding to a set of sub-pixels, at least one of the plurality of display data fields stores data determined by filtering of the data of the sub-pixel data field of the entry, and the control field stores data representing a relationship between the sub-pixel data field of the entry and each of the plurality of display data fields of the entry.

14 Claims, 5 Drawing Sheets

FIG. 3
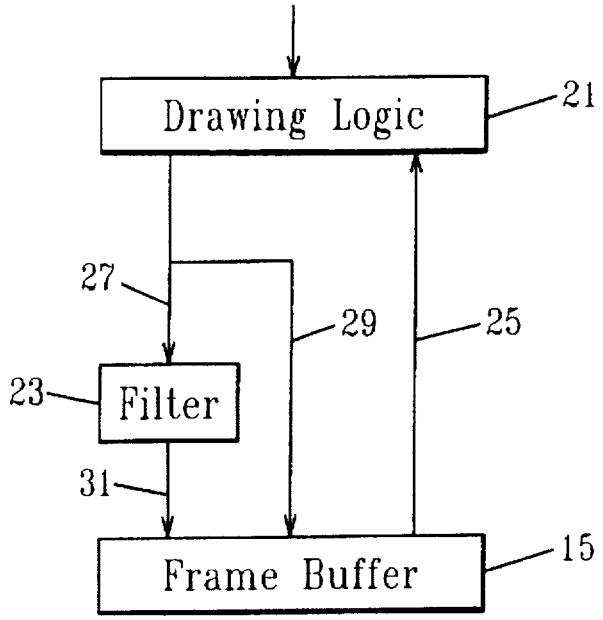
FIG. 4
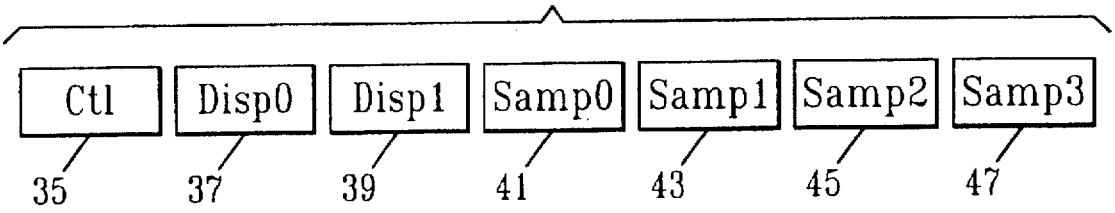
FIG. 5 PRIOR ART
| | | | | | | | |
|---|---|---|---|---|---|---|---|
| Pixel | Pixel | Pixel | Pixel | Pixel | Pixel | Pixel | Pixel |
| Pixel | Pixel | Pixel | Pixel | Pixel | Pixel | Pixel | Pixel |
| Pixel | Pixel | Pixel | Pixel | Pixel | Pixel | Pixel | Pixel |
| Pixel | Pixel | Pixel | Pixel | Pixel | Pixel | Pixel | Pixel |
| Pixel | Pixel | Pixel | Pixel | Pixel | Pixel | Pixel | Pixel |

COMPUTER GRAPHICS SYSTEM AND METHOD EMPLOYING FRAME BUFFER HAVING SUBPIXEL FIELD, DISPLAY FIELDS AND A CONTROL FIELD FOR RELATING DISPLAY FIELDS TO THE SUBPIXEL FIELD

BACKGROUND OF THE INVENTION

1. Technical Field

The present invention relates to three-dimensional graphics systems and, more particularly, to three-dimensional graphics systems that employ both supersampling and double-buffering techniques.

2. Description of the Related Art

In raster graphics systems, color information of a plurality of pixels to be displayed are stored in the form of a lattice, as shown in FIG. 5. The number of pixels depends upon the display resolution of the display. Aliasing occurs as the result of the separation between the pixels of the display. For example, the effects of aliasing are apparent when an oblique line is displayed as a staircase on the display. Even if the number of pixels is increased, aliasing may still occur.

In order to eliminate this aliasing (this elimination process will hereinafter be referred to as antialiasing), there is a method in which one pixel may be divided into subpixels to calculate the color of the subpixel, the subpixels are averaged (or filtered), and the averaged or filtered color of the subpixels is regarded as the color of that one pixel. This is called supersampling.

FIG. 6 shows an example of one pixel consisting of four subpixels. For the same display resolution, the frame buffer of this case (supersampling) requires four times as much area as a frame buffer for which such supersampling is not performed.

Supersampling is extremely effective because it can perform antialiasing even when polygon drawing is performed. In addition, the processing is simple, so a system for performing supersampling can be easily configured. Supersampling is expensive, however, because it uses up large amounts of frame buffer area.

If drawing is performed on a frame buffer during display, the screen will be extremely difficult to look at, and optical illusions will occur. As a means for preventing this, there is a method in which a frame buffer has two blocks and one block is switched to the other block. That is, while one frame buffer block is being displayed, drawing is performed on the other frame buffer block. When drawing has been completed, the displayed buffer block and the buffer block on which drawing was performed will be switched. This is called double-buffering.

The operation involving double-buffering will now be described with reference to FIG. 7. In the first stage, data is read from a buffer block 0 and displayed on a display. During this processing, drawing is performed on a buffer block 1 by a drawing processor. When this drawing is completed, the first stage will advance to a second stage. In the second stage, data is read from the buffer block 1 on which drawing has been completed and displayed on the display. During this processing, data is written to the buffer 0. Repeating these steps enables display to be performed smoothly. This switching is ordinary performed in synchronization with vertical retrace.

Such double-buffering is becoming indispensable to an animation and computer-aided design (CAD). This method, however, requires a large frame buffer which is twice the size of the conventional frame buffer, and thus expensive.

As described above, when both supersampling and double-buffering are performed, the picture quality of the displayed image is excellent. In supersampling, however, the size of the frame buffer depends on the number of subpixels and, if one pixel comprises four subpixels, the frame buffer will then required four times the size of the conventional frame buffer. In this case, if double-buffering is used together with supersampling, the frame buffer required is 8 times the size of the conventional frame buffer. Obviously, then, if the number of subpixels used in supersampling is increased, the size of the required frame buffer will be increased correspondingly. Therefore, supersampling and double-buffering requires a large frame buffer area, and thus is extremely expensive as a whole.

It is therefore an object of the present invention to provide an inexpensive graphics system that includes both supersampling and double-buffering techniques.

Another object of the present invention is to provide supersampling and the double-buffering techniques that have better cost performance while minimizing the influence on the existing graphics API.

SUMMARY OF THE INVENTION

The present invention, which is capable of achieving the objects described above, is a computer graphics system for generating pixel data corresponding to a plurality of pixels to be displayed. The system of the present invention includes a frame buffer including entries associated with each of the pixels to be displayed. Each entry includes a sub-pixel data field, a plurality of display data fields, and a control field. For each entry, the sub-pixel data field stores data corresponding to a set of sub-pixels, at least one of the plurality of display data fields stores data determined by filtering of the data of the sub-pixel data field, and the control field stores data representing relationship between the sub-pixel data field of the entry and each of the plurality of display data fields of the entry. The system preferably includes a drawing unit and a filter. The drawing unit generates the data stored in the sub-pixel field for each entry, and generates the control field for each entry. The filter generates the plurality of display data fields of each entry as a function of the data stored in the sub-pixel data field of the entry, and writes the plurality of display data fields to each entry.

The control field of each entry preferably includes a plurality of bits, each bit associated with one of the plurality of display data fields, and each bit indicating whether the associated one display data field has been determined by filtering of the data of the sub-pixel data field of the entry.

Double-buffering is performed by selectively outputting the display data fields of the entries of the frame buffer.

BRIEF DESCRIPTION OF THE DRAWINGS

FIG. 3 is a block diagram of the frame buffer drawing unit and the frame buffer of FIG. 2 according to the present invention;

FIG. 4 shows the construction of one pixel of the frame buffer;

FIG. 5 shows the state of the screen of a display;

DETAILED DESCRIPTION OF THE PREFERRED EMBODIMENTS

Figure 1:
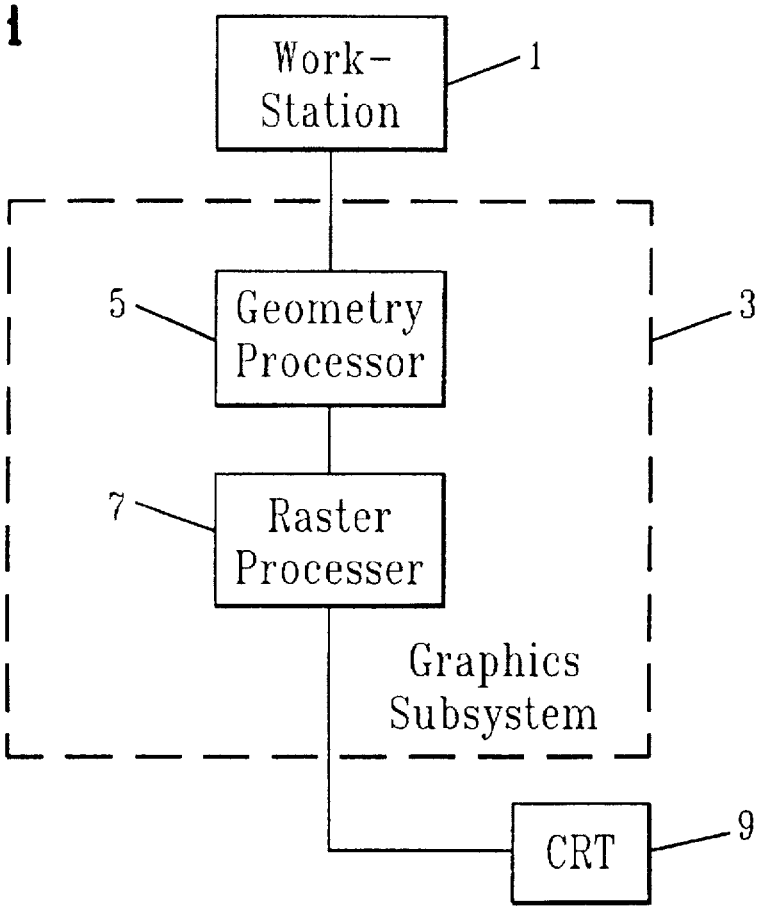
FIG. 1 is a block diagram of the entire configuration of the present invention.

FIG. 1 shows a system that embodies the present invention. A system 1 includes a main central processing unit (CPU), a main memory, input-output devices such as a keyboard and a printer, and storage devices such a floppy-disk drive (FDD) or hard-disk drive (HDD). This system 1 is connected through a bus to a graphics subsystem 3, and the output of the subsystem 3 is displayed on a cathode-ray tube (CRT) display 9. The graphics subsystem 3 is configured with a geometry processor 5 and a raster processor 7.

Figure 2:
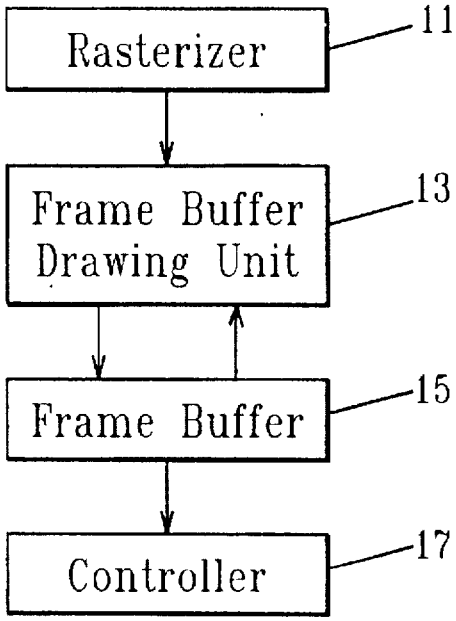
FIG. 2 is a block diagram of the raster processor of FIG. 1.

This raster processor 7 is shown more specifically in FIG. 2. The raster processor 7 includes a rasterizer 11, a frame buffer drawing unit 13, a frame buffer 15, and a controller 17. The controller 17 is connected to the CRT display 9.

The operation of the system of FIGS. 1 and 2 will now be described. To display a three-dimensional model or scene on the CRT display 9, the CPU of the system 1 will send a drawing instruction to the graphics subsystem 3. For example, when the CPU instructs the graphics subsystem 3 to draw objects of a certain color in a certain position (total coordinates), the geometry processor 5 divides the objects into a plurality of polygons, obtains the screen coordinates of the vertex of each polygon, and computes the color information on these coordinates. Based on this result, the rasterizer 11 of the raster processor 7 computes the coordinates and color information for pixels inside each polygon. The frame buffer drawing unit 13 writes the computed coordinates and color information of the pixels to the frame buffer 15, and the controller 17 reads the contents of the frame buffer 15 and outputs them to the CRT display 9.

There are some cases in which the above-described object is a line or a point and, in such cases, the output of the geometry processor 5 is output not for each polygon but for each line or point. Also, there is also a case in which the frame buffer drawing unit 13 only writes to the frame buffer 15, but generally the contents of the frame buffer 15 change based on the output of the rasterizer 11. Writing is also thought to be such that the contents of the frame buffer 15 are replaced by the output of the rasterizer 11. There are some cases in which such a change is indicated by the CPU of the system 1. The connection between the frame buffer drawing unit 13 and the frame buffer 15 is then bidirectional.

According to the present invention, the raster processor 7 includes the frame buffer drawing unit 13 and the frame buffer 1 as shown in FIG. 3. The frame buffer drawing unit 13 includes a drawing logic 21 and a filter 23. The drawing logic 21 is connected to the frame buffer 15 through a bus 25 for reading the content of the frame buffer 15 and through a bus 29 for writing the contents computed by the drawing logic 21 to the frame buffer 15. Also, the drawing logic 21 and the filter 23 are connected by a bus 27, and the filter 23 and the frame buffer 15 are connected by a bus 31.

The drawing logic 21 receives certain coordinates and color information on a screen and also operating instructions such as replacement and blending, which are output from the rasterizer 11 in FIG. 2. An address in the frame buffer 15 corresponding to certain coordinates on a screen is obtained, and the contents of the address is read from the frame buffer 15. An operation, which is instructed by read contents and color information from the rasterizer 11, is performed, and the color information generated is written to the above-described original address. This color information is also output to the filter 23 and filtered (ordinarily, averaged). This filtered color information is also written to the frame buffer 15. The controller 17 in FIG. 2 reads the written color information of the frame buffer 15 and outputs it to the CRT display 9.

Figure 6:
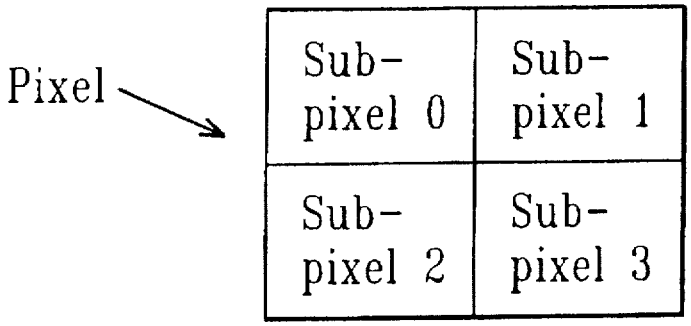
FIG. 6 PRIOR ART
FIG. 6 is a diagram that illustrates supersampling.
Figure 7:
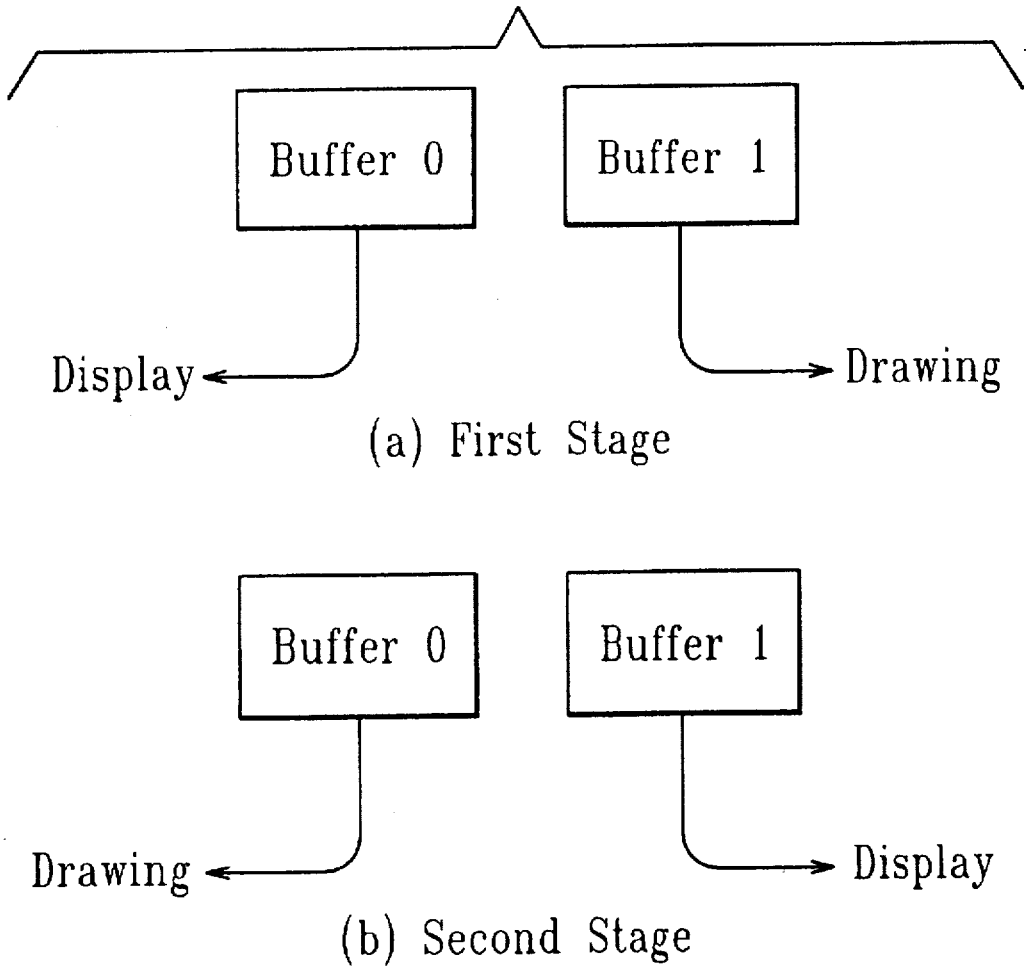
FIG. 7 PRIOR ART
FIG. 7 is a diagram used to illustrating double-buffering.

FIG. 4 shows the construction of one pixel in the frame buffer 15. This is an example of a case in which each pixel includes four subpixels 0 to 3 as shown in FIG. 6. The contents of the subpixels 0 to 3 are held in "Samp0" to "Samp3." Also, the filtered (or averaged) contents of these subpixels at a certain point in time is written to a display buffer "disp0" and a display buffer "disp1."

Each pixel further includes control bits "ct10" representing the relationship between the result of filtering of Samp0 to Samp3 and the contents of disp0 and disp1. The control bits ct1 comprise two bits indicating the following: If the control bits ct1 are 00, disp0=disp1=filtering (subpixel). If the control bits are 01, disp0=filtering (subpixel) and disp1≠filtering (subpixel). If the control bits are 10, disp0≠filtering (subpixel) and disp1=filtering (subpixel). If the control bits are 11, disp0≠filtering (subpixel) and disp1≠filtering (subpixel). The "filtering (subpixel)" is the result of the filtering of Samp0 to Samp3.

Figure 8A:
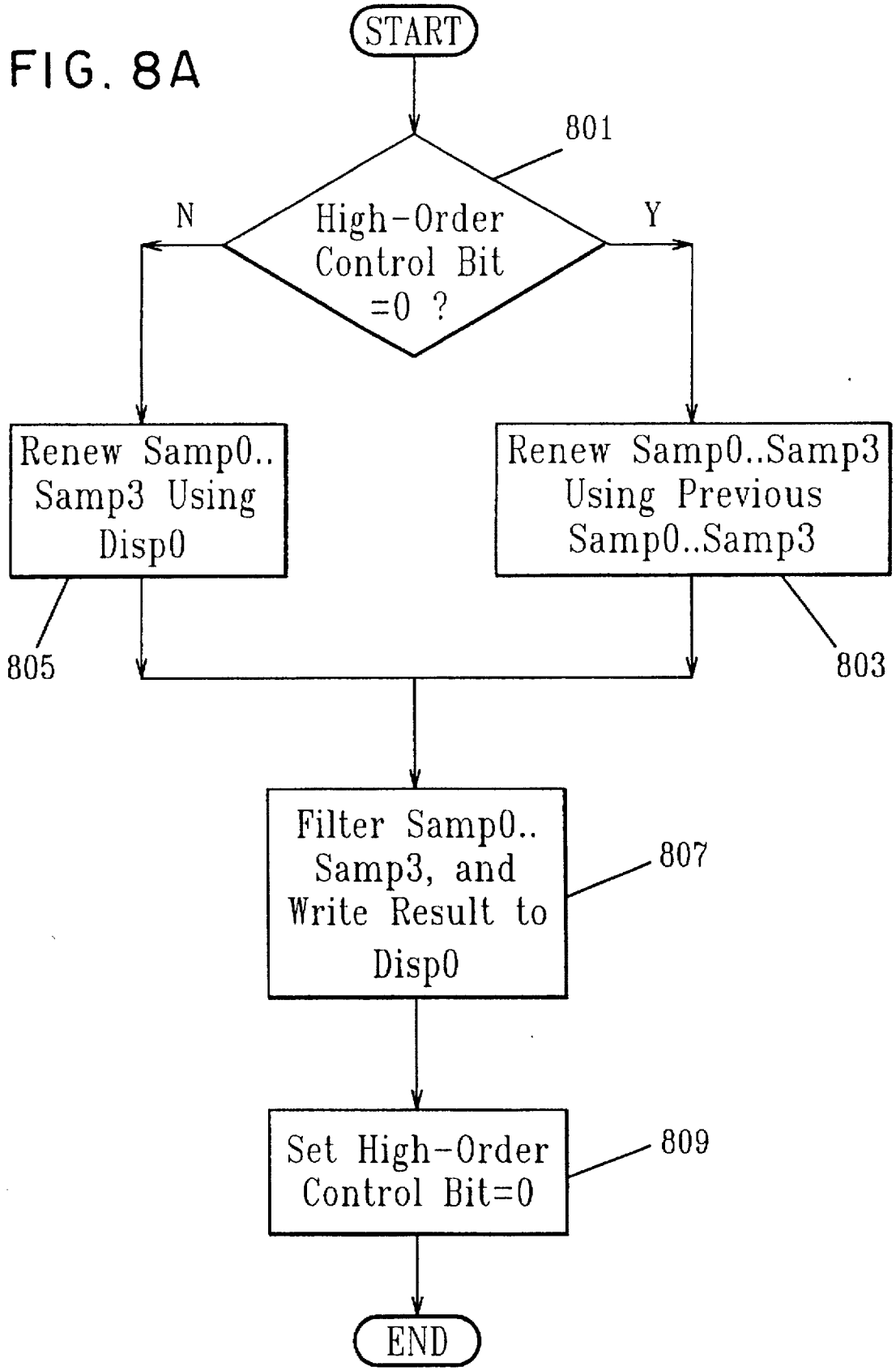
FIGS. 8(A) and (B) illustrate operation of the drawing logic and filter of FIG. 3 in generating the display buffers of the frame buffer according to the present invention.
Figure 8B:
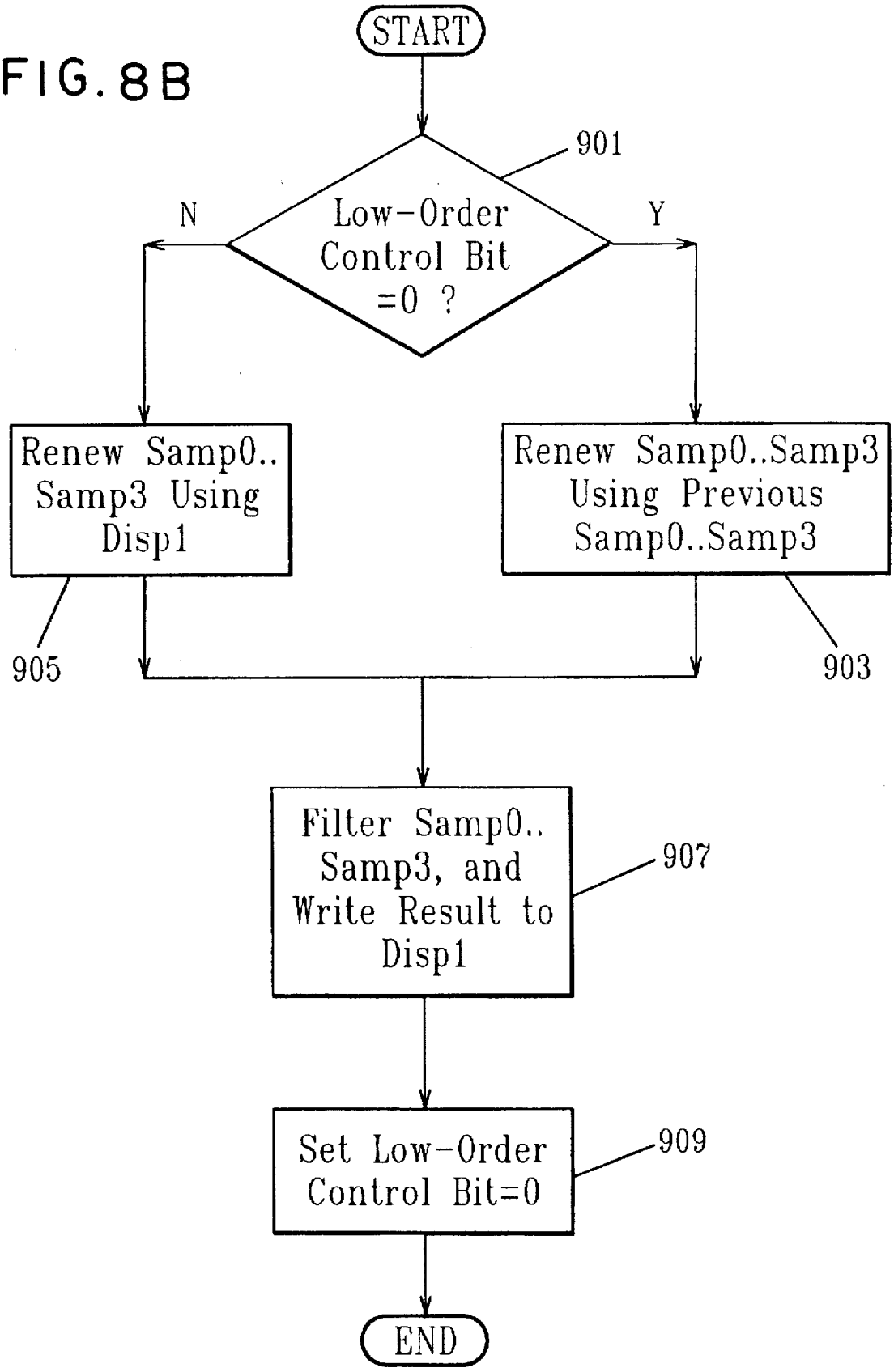

The control bits ct1 are set when the drawing logic 21 generates and writes new contents of the subpixel by performing an operation such as replacement. The operation of the drawing logic 21 and the filter 23 in processing each pixel of the frame buffer 15 for two successive periods, period 0 and period 1, are illustrated in FIGS. 8(A) and (B). FIG. 8(A) illustrates the operation of the drawing logic 21 and the filter 23 during period 0 wherein the contents of the display buffer disp1 are output from the frame buffer 15 for display. FIG. 8(B) illustrates the operation of the drawing logic 21 and the filter 23 during period 1 wherein the contents of display buffer disp0 are output from the frame buffer 15 for display.

As shown in FIG. 8(A), during the processing of period 0, the high-order bit of the control bits ct1 and the portion of the display buffer disp0 for the particular pixel are determined as follows.

In step 801, the drawing logic 21 determines if the high-order bit of the control bits ct1 for the particular pixel is 0 or 1. If in step 801 the drawing logic 21 determines the high-order bit of the control bits ct1 for the particular pixel is 0, then the drawing logic 21 performs the following in step 803:

(a) The drawing logic 21 reads Samp0 for the particular pixel from the frame buffer 15, processes Samp0 according to predetermined processing (replacement, blending, etc.), and writes the result back to Samp0 for the particular pixel. At or near the same time that the result is written to Samp0 for the particular pixel, preferably the drawing logic 21 outputs the result to the filter 23.

(b) The drawing logic 21 reads Samp1 for the particular pixel from the frame buffer 15, processes Samp1 according to predetermined processing (replacement, blending, etc.), and writes the result back to Samp1 for the particular pixel. At or near the same time that the result is written to Samp1 for the particular pixel, preferably the drawing logic 21 outputs the result to the filter 23.

(c) The drawing logic 21 reads Samp2 for the particular pixel from the frame buffer 15, processes Samp2 according to predetermined processing (replacement, blending, etc.), and writes the result back to Samp2 for the particular pixel. At or near the same time that the result is written to Samp2 for the particular pixel, preferably the drawing logic 21 outputs the result to the filter 23.

(d) The drawing logic 21 reads Samp3 for the particular pixel from the frame buffer 15, processes Samp3 according to predetermined processing (replacement, blending, etc.), and writes the result back to Samp3 for the particular pixel. At or near the same time that the result is written to Samp3 for the particular pixel, preferably the drawing logic 21 outputs the result to the filter 23.

(e) operation then continues to step 807 as described below.

However, if in step 801 the drawing logic 21 determines the high-order bit of the control bits ct1 is 1, then the drawing logic 21 performs the following in step 805:

(a) The drawing logic 21 reads disp0 for the particular pixel from the frame buffer 15.

(b) The drawing logic 21 processes disp0 according to predetermined processing (replacement, blending, etc.) and writes the result to Samp0 for the particular pixel. At or near the same time that the result is written to Samp0 for the particular pixel, preferably the drawing logic 21 outputs the result to the filter 23.

(c) The drawing logic 21 processes disp0 according to predetermined processing (replacement, blending, etc.) and writes the result to Samp1 for the particular pixel. At or near the same time that the result is written to Samp1 for the particular pixel, preferably the drawing logic 21 outputs the result to the filter 23.

(d) The drawing logic 21 processes disp0 according to predetermined processing (replacement, blending, etc.) and writes the result to Samp2 for the particular pixel. At or near the same time that the result is written to Samp2 for the particular pixel, preferably the drawing logic 21 outputs the result to the filter 23

(e) The drawing logic 21 processes disp0 according to predetermined processing (replacement, blending, etc.) and writes the result to Samp3 for the particular pixel. At or near the same time that the result is written to Samp3 for the particular pixel, preferably the drawing logic 21 outputs the result to the filter 23.

(f) operation continues to step 807.

In step 807, a filtering process (normally, averaging process) of the new Samp0 to the new Samp3 output from the drawing logic 21 is performed in the filter 23, and the result is written to disp0. And in step 809, after the filter 23 writes the result to disp0, the drawing logic 21 sets the high-order bit of the control bits ct1 of the particular pixel to 0.

In the steps described above, the addresses of Samp0 to Samp3 are computed from the coordinates of the pixel on the screen output from the rasterizer 11 in FIG. 2 by the drawing logic 21. Preferably, the address of disp0 is computed by the drawing logic 21 and output to the filter 23.

As shown in FIG. 8(B), during the processing of period 1, the low-order bit of the control bits ct1 and the portion of the display buffer disp1 for the particular pixel are determined as follows.

In step 901, the drawing logic 21 determines if the low-order bit of the control bits ct1 for the particular pixel is 0 or 1. If in step 901 the drawing logic 21 determines the low-order bit of the control bits ct1 for the particular pixel is 0, then the drawing logic 21 performs the following in step 903:

(a) The drawing logic 21 reads Samp0 for the particular pixel from the frame buffer 15, processes Samp0 according to predetermined processing (replacement, blending, etc.), and writes the result back to Samp0 for the particular pixel. At or near the same time that the result is written to Samp0 for the particular pixel, preferably the drawing logic 21 outputs the result to the filter 23.

(b) The drawing logic 21 reads Samp1 for the particular pixel from the frame buffer 15, processes Samp1 according to predetermined processing (replacement, blending, etc.), and writes the result back to Samp1 for the particular pixel. At or near the same time that the result is written to Samp1 for the particular pixel, preferably the drawing logic 21 outputs the result to the filter 23.

(c) The drawing logic 21 reads Samp2 for the particular pixel from the frame buffer 15, processes Samp2 according to predetermined processing (replacement, blending, etc.), and writes the result back to Samp2 for the particular pixel. At or near the same time that the result is written to Samp2 for the particular pixel, preferably the drawing logic 21 outputs the result to the filter 23.

(d) The drawing logic 21 reads Samp3 for the particular pixel from the frame buffer 15, processes Samp3 according to predetermined processing (replacement, blending, etc.), and writes the result back to Samp3 for the particular pixel. At or near the same time that the result is written to Samp3 for the particular pixel, preferably the drawing logic 21 outputs the result to the filter 23.

(e) operation then continues to step 907 as described below.

However, if in step 901 the drawing logic 21 determines the low-order bit of the control bits ct1 is 1, then the drawing logic 21 performs the following in step 905:

(a) The drawing logic 21 reads disp1 for the particular pixel from the frame buffer 15.

(b) The drawing logic 21 processes disp1 according to predetermined processing (replacement, blending, etc.) and writes the result to Samp0 for the particular pixel. At or near the same time that the result is written to Samp0 for the particular pixel, preferably the drawing logic 21 outputs the result to the filter 23.

(c) The drawing logic 21 processes disp1 according to predetermined processing (replacement, blending, etc.) and writes the result to Samp1 for the particular pixel. At or near the same time that the result is written to Samp1 for the particular pixel, preferably the drawing logic 21 outputs the result to the filter 23.

(d) The drawing logic 21 processes disp1 according to predetermined processing (replacement, blending, etc.) and writes the result to Samp2 for the particular pixel. At or near the same time that the result is written to Samp2 for the particular pixel, preferably the drawing logic 21 outputs the result to the filter 23.

(e) The drawing logic 21 processes disp1 according to predetermined processing (replacement, blending, etc.) and writes the result to Samp3 for the particular pixel. At or near the same time that the result is written to Samp3 for the particular pixel, preferably the drawing logic 21 outputs the result to the filter 23.

(f) operation continues to step 907.

In step 907, a filtering process (normally, averaging process) of the new Samp0 to the new Samp3 output from the drawing logic 21 is performed in the filter 23, and the result is written to disp1. And in step 909, after the filter 23 writes the result to disp1, the drawing logic 21 sets the low-order bit of the control bits ct1 of the particular pixel to 0.

In the steps described above, the addresses of Samp0 to Samp3 are computed from the coordinates of the pixel on the screen output from the rasterizer 11 in FIG. 2 by the drawing logic 21. Preferably, the address of disp1 is computed by the drawing logic 21 and output to the filter 23.

While the foregoing has been described on the assumption that supersampling is performed, there are some cases in which supersampling is not performed. In this case, the frame buffer 15 does not include the sub-pixel information Samp0 to Samp3 for each pixel. In such cases, the following processing may be performed for each pixel of the frame buffer 15. During period 0, when writing to disp0, the following steps are performed:

(1) The drawing logic 21 reads disp0 for the particular pixel from the frame buffer 15 and after predetermined processing writes the result back to disp0.

(2) The one high-order bit of the control bits ct1 are set to 1 by the drawing logic 21.

And during period 1, when writing to disp1, the following steps are performed:

(1) The drawing logic 21 reads disp1 from the frame buffer 15 and after predetermined processing writes the result back to disp1.

(2) The one low-order bit of the control bit is set to 1 by the drawing logic 21.

In this manner, the present invention may be utilized in both graphics systems that support supersampling (e.g., graPHIGS) and graphics systems that do not support supersampling (e.g., X).

When supersampling is supported in the present invention, an error occurs when the control bits associated with both disp0 and disp1 are 1 (i.e., the control bits ct1 are '11'). However, this error can be allowed, for the following reasons and from the standpoint of the effect that the above-described problems could be solved and cost reduced:

The reasons are as follows: (1) An error occurs when a place to be drawn is switched from disp0 to disp1 (or vice versa) while the drawing operation is being performed by the API supporting supersampling. However, since, in many cases the screen is normally erased before drawing is started and, in such cases, an error does not occur, there are few cases where an error occurs practically. (2) Even if an error occurred, there would no possibility that the picture quality would deteriorate, as compared to a case where supersampling is not performed. (3) When the number of buffers is the same, there are also some cases in which, even if there were an error, increasing the number of sampling points would be better than having subpixels completely doubled without an error. Thus it is determined that such errors are allowable.

While supersampling and double-buffering can be performed, without having twice as many subpixels, by configuring the frame buffer and operating the drawing logic in the above-described manner, the present invention is not limited to the embodiment described above. For example, the drawing logic 21 and the filter 23 may be formed separately, but one drawing logic may have both functions. Also, the corresponding relationship between the content and meaning of the control bit is not limited to this embodiment, but the meanings of the high-order and low-order bits, or the meanings of 1 and 0 may be interchanged. Furthermore, while this embodiment has mainly been described in regard to a case where the number of subpixels is 4, the present invention is not limited to 4 but it may be more than one integer, although, some power of 2 is preferable. Also, while the number of display buffers has been 2, double-buffering can be performed with more than two display buffers. Even if the number of display buffers were more than two and display information at a certain point in time were stored, there would be some useful cases. However, there is also the drawback that the frame buffer would increase in size, although not as much as with the conventional method.

The advantage of the present invention is that there is provided an inexpensive system which performs both supersampling and double-buffering. Judging from concrete figures, in the case where the number of subpixels is 4, the frame buffer according to the present invention is 6 times the size of an ordinary frame buffer and control bits, but the frame buffer of the prior art is 8 times the size of the ordinary frame buffer. Also, in the case where the number of subpixels is 8, the frame buffer of the present invention is 10 times the size of the ordinary frame buffer and control bits, but the frame buffer of the prior art is 16 times the size of the ordinary frame buffer. In the case where the number of subpixels is 16, the frame buffer according to the present invention is 18 times the size of the ordinary frame buffer and control bits, but the frame buffer of the prior art is 32 times the size of the ordinary frame buffer. Thus, the number of bits of the buffer frame can be considerably saved and the system becomes less expensive. Note that the "ordinary" frame buffer means a frame buffer in which both supersampling and double-buffering are not performed.

Also, since such saving was made possible by providing control bits and display buffers, both supersampling and double-buffering could be performed with a simple configuration.

Also, supersampling and double-buffering could be performed with better cost performance, while minimizing the influence on the existing graphics API.

Other embodiments of the invention will be apparent to those skilled in the art from consideration of the specification and practice of the invention disclosed herein. It is intended that the specification and examples be considered as examples only, with the true scope of the invention being indicated by the claims.

I claim:

1. A computer graphics system for generating pixel data corresponding to a plurality of pixels to be displayed, comprising:

a frame buffer including entries associated with each of said pixels, each of said entries including a sub-pixel data field, a plurality of display data fields, and a control field, wherein for each entry, said sub-pixel data field stores data corresponding to a set of sub-pixels, at least one of said plurality of display data fields stores data determined by filtering of said data of said sub-pixel data field of said entry, and said control field stores data representing relationship between said sub-pixel data field of said entry and each of said plurality of display data fields of said entry.

2. The computer graphics system of claim 1, wherein said control field of said entry includes a plurality of bits, each bit associated with one of said plurality of display data fields, and each bit indicating whether the associated one display data field has been determined by filtering of said data of said sub-pixel data field of said entry.

3. The computer graphics system of claim 1, further comprising:

drawing means for generating said data stored in said sub-pixel data field for each entry, and for generating said control field for each entry.

4. The computer graphics system of claim 3, wherein said drawing means generates said data stored in said sub-pixel data field for a particular entry as a function of said control field of said particular entry.

5. The computer graphics system of claim 4, wherein said drawing means generates said data stored in said sub-pixel field for a particular entry as a function of data previously stored in said sub-pixel field of said particular entry.

6. The computer graphics system of claim 1, further comprising:

filtering means for generating said plurality of display data fields of each entry as a function of said data stored in said sub-pixel data field of said entry, and for writing said plurality of display data fields to each entry.

7. In a computer graphics system that generates pixel data corresponding to a plurality of pixels to be displayed, the system including a frame buffer comprising entries associated with each of said pixels, each entry including a sub-pixel data field, a plurality of display data fields, and a control field, a method for generating said pixel data comprising the steps of:

for each entry of said frame buffer, (a) generating sub-pixel data corresponding to a set of sub-pixels, and writing said sub-pixel data to said sub-pixel data field of said entry;

(b) filtering said sub-pixel data stored in said sub-pixel data field of said entry, and writing a result of said filtering to at least one of said plurality of display data fields of said entry; and (c) generating condition data representing relationship between said sub-pixel data field of said entry and each of said plurality of display data fields of said entry, and writing said condition data to said control field of said entry.

8. The method of claim 7, wherein said control field of said entry includes a plurality of bits, each bit associated with one of said plurality of display data fields, and each bit indicating whether the associated one display data field has been determined by filtering of said sub-pixel data of said sub-pixel data field of said entry.

9. The method of claim 7, wherein the sub-pixel data generated in step (a) is generated as a function of data stored in said control field of said entry.

10. The method of claim 7, wherein the sub-pixel data generated in step (a) is generated as a function of data previously stored in said sub-pixel field of said entry.

11. A computer graphics system for generating pixel data corresponding to a plurality of pixels to be displayed, comprising:

a frame buffer including entries associated with each of said pixels, each of said entries including a sub-pixel data field, a plurality of display data fields, and a control field, wherein for each entry, said sub-pixel data field stores data corresponding to a set of sub-pixels, at least one of said plurality of display data fields stores data determined by filtering of said data of said sub-pixel data field of said entry, and said control field stores data representing relationship between said sub-pixel data field of said entry and each of said plurality of display data fields of said entry;

drawing means for generating said data stored in said sub-pixel field for each entry, and for generating said control field for each entry; and filtering means for generating said plurality of display data fields of each entry as a function of said data stored in said sub-pixel data field of said entry, and for writing said plurality of display data fields to each entry.

12. The computer graphics system of claim 11, wherein said control field of said entry includes a plurality of bits, each bit associated with one of said plurality of display data fields, and each bit indicating whether the associated one display data field has been determined by filtering of said data of said sub-pixel data field of said entry.

13. The computer graphics system of claim 11, wherein said drawing means generates said data stored in said sub-pixel field for a particular entry as a function of data stored in said control field of said particular entry.

14. The computer graphics system of claim 11, wherein said drawing means generates said data stored in said sub-pixel field for a particular entry as a function of data previously stored in said sub-pixel field of said particular entry.

* * * * *